US005135323A

United States Patent [19]

Pinheiro

[11] Patent Number: 5,135,323

[45] Date of Patent: Aug. 4, 1992

[54] RING BINDER

[75] Inventor: Antonio Pinheiro, N. Dartmouth, Mass.

[73] Assignee: U.S. Ring Binder, New Bedford, Mass.

[21] Appl. No.: 734,563

[22] Filed: Jul. 23, 1991

[51] Int. Cl.[5] ..... B42F 13/16

[52] U.S. Cl. ..... 402/38; 402/41

[58] Field of Search ..... 402/36, 37, 38, 41, 402/80 R

[56] References Cited

U.S. PATENT DOCUMENTS

| | | | |
|---|---|---|---|
| 1,857,287 | 5/1932 | Schade | 402/38 |
| 1,953,981 | 4/1934 | Trussell | 402/38 |
| 2,056,812 | 10/1936 | Unger | 402/38 |
| 2,105,235 | 1/1938 | Schade | 402/38 |
| 2,673,564 | 3/1954 | Derringer | 402/38 |
| 3,098,490 | 7/1963 | Wance | 402/38 |
| 3,101,719 | 8/1963 | Vernon | 402/38 |
| 3,884,586 | 5/1975 | Michaelis et al. | 402/38 |
| 4,813,803 | 3/1989 | Gross | 402/38 |

*Primary Examiner*—Paul A. Bell

*Attorney, Agent, or Firm*—Hill, Van Santen, Steadman & Simpson

[57] ABSTRACT

A locking ring binder assembly has a resilient sheet metal cover and a pair of operating levers rotatably mounted on the covers. A projection on the operating levers beneath the cover and a leg portion on the operating levers in alignment with the projection through a thickness of the cover locks the binder in a closed position even though the operating levers are not rotated to an over center position.

12 Claims, 2 Drawing Sheets

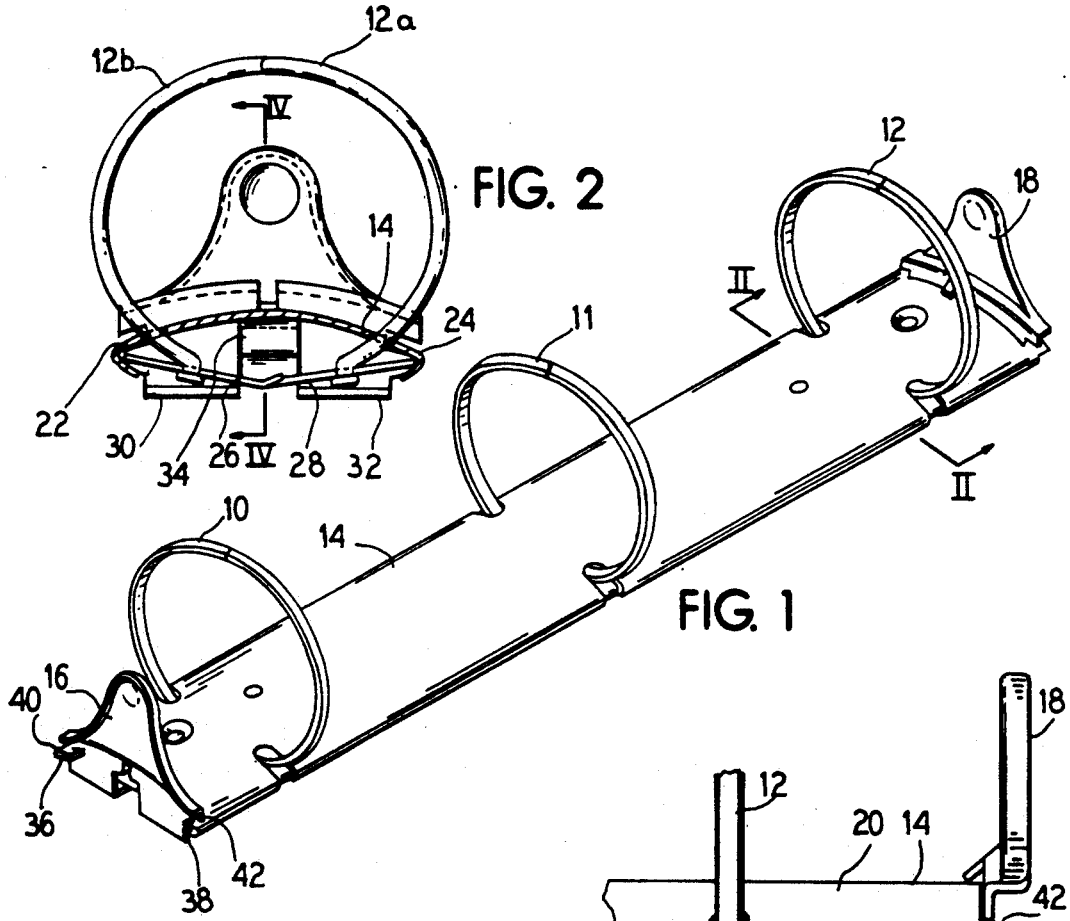
FIG. 2
FIG. 1
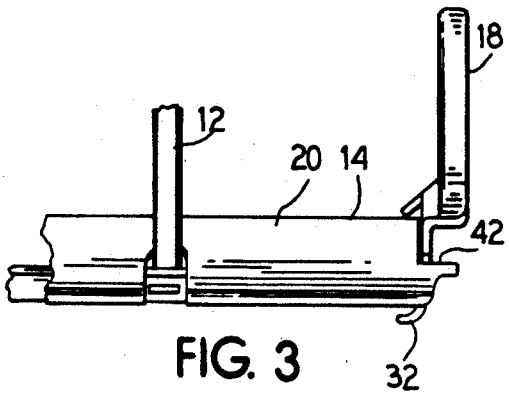
FIG. 3
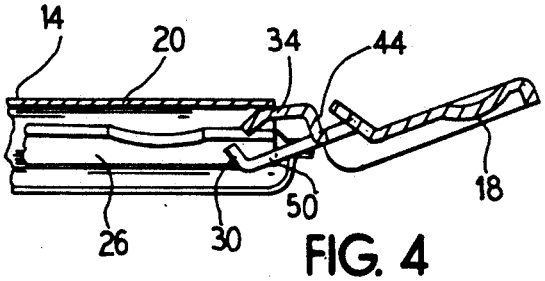
FIG. 4

RING BINDER

BACKGROUND OF THE INVENTION

Various constructions of ring binders are known, in which a plurality of rings, normally closed, can be selectively opened to add or replace pages in a sheaf of pages held together by the rings. It is desirable that the rings be locked in closed position, for some applications, to prevent an inadvertent opening of the rings.

To that end, a variety of constructions have been proposed, generally using a pair of levers at opposite ends of the frame of the binder, by which the rings can be selectively opened. When the levers, sometimes referred to as triggers, are in closed position, an interlock arrangement prevents the rings from being opened inadvertently. One such construction is disclosed by U.S. Ser. No. 635,284 filed Dec. 28, 1990, assigned to assignee of present invention.

It is desirable to provide an improved construction for such a locking ring binder, to achieve the advantages of simplicity of construction, which promotes ease of manufacturing of a low cost locking ring binder.

SUMMARY OF THE INVENTION

It is a principal object of the present invention to provide an improved construction for a locking ring binder, by which the locking action of an operating lever therefor is achieved by the inter-relationship of a leg portion and an underlying surface carried by the operating lever adapted to selectively open the rings, and a cover member or shield of the binder.

The operating lever or levers are rotatably carried on the cover member and are locked in position on the cover member when the underlying surface interfits under the cover member and the leg portion overlies the cover member in substantial alignment through the thickness of the cover member. The underlying surface can carry a bump or projection which enhances the locking effect. The bump is arranged in substantial alignment with the distal end of the leg portion through the thickness of the cover member.

The construction of the present invention provides the advantage of an economical and easily assembled locking ring binder structure, in which the operating levers are rotatable through a relatively small angle, which is less than an "over center" position relative to their axes of rotation.

These and other objects and advantages of the present invention will become manifest by an inspection of the accompanying drawings and the following description.

DESCRIPTION OF THE DRAWINGS

Reference will now be made to the accompanying drawings in which:

FIG. 1 is a perspective view of a ring binder construction incorporating an illustrative embodiment of the present invention;

FIG. 2 is a cross sectional view taken generally along line II—II of the ring binder of FIG. 1;

FIG. 3 is a side view of a portion of the ring binder of FIG. 1;

FIG. 4 is a cross sectional view taken generally along line IV—IV of FIG. 2 with the operating lever shown in open position;

DESCRIPTION OF THE PREFERRED EMBODIMENTS

Figure 5:
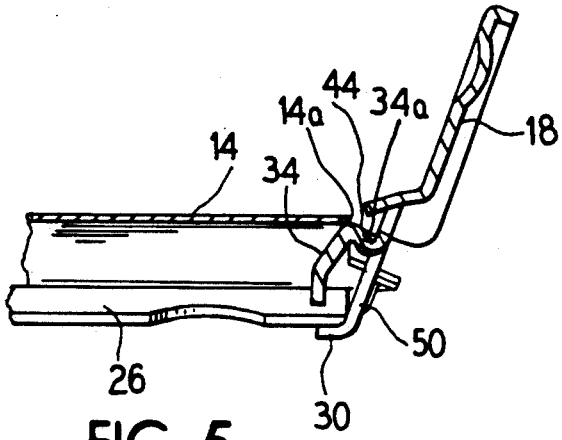
FIG. 5 is a cross sectional view of the ring binder of FIG. 4, with the operating lever shown in unlocked position.

Referring now to the drawings, FIG. 1 illustrates a perspective view of a locking ring binder incorporating the present invention. The binder incorporates a plurality of two-part rings 10, 11 and 12, which may be selectively opened and closed, a cover or shield member 14, and a pair of operating levers 16 and 18 at opposite ends of the cover. The operating levers 16 and 18 are secured to the cover in a way which allows them to be rotated from a locking position as shown in FIG. 1, toward an unlocked position, in which the lever is moved away from the rings 10 and 12.

When the levers 16 and 18 are moved to their unlocked position, the rings 10, 11 and 12 may be opened manually if desired. However, if the levers 16 and 18 are moved with a continued rotation, via beyond their unlocked position, they themselves force open the rings 10, 11 and 12.

As FIG. 2 shows, the cover member 14 is formed of resilient sheet material with a cylindrical upper surface 20, with U-shaped side margins 22 and 24, which resiliently trap a pair of hinge leaves or ribs 26 and 28, to which the rings 10, 11 and 12 are firmly connected. When the hinge leaves are in the position illustrated in FIG. 2, they form a "V", and the two-part rings 10, 11 and 12 are closed. If a force is applied to cause the hinge plates 26 and 28 to move upwardly, to form an inverted or upward pointed "V", then the right hand ring half **12*a* is rotated in a clockwise direction, and the left half 12*b* is rotated in a counterclockwise direction, to open the rings. The cover member 14, at the margins 22, 24, resiliently urges peripheral portions of the hinge leaves 26, 28 toward each other, thereby to hold the rings 10, 11 and 12 in open position or closed position. The movement of the leaves 26, 28 is facilitated by a pair of L-shaped actuators 30 and 32, formed at the bottom of each of the levers 16 and 18. The actuators 30 and 32 move the hinge leaves 26 and 28 into their upper position as the levers 16 and 18 are rotated, so that the actuators 30 and 32 bear on the underside of the leaves 26 and 28 to force them upwardly. This occurs when the lever 16 and 18 are rotated from the locked position to the open position. In like manner, when the levers 16 and 18 are rotated from their open position to their locked position, the leaves 26 and 28 are forced downwardly to form the "V" orientation illustrated in FIG. 2. This occurs by means of tongue 34, which is provided at a center location in each of the levers 16 and 18**.

The levers 16 and 18 are secured to the cover member 14, by virtue of tabs 36 and 38, formed integrally with the shield member 14, which are received in slots 40 and 42 formed at the side edges of the levers 16 and 18. The tabs 36 and 38 are bent over, to retain the levers 16 and 18 in position at the ends of the shield member 14, but the slots 40 and 42 are sufficiently large to allow each of the levers 16 and 18 to rotate relative to the shield member 14, while being held in position by the bent over tabs 36 and 38.

Figure 6:
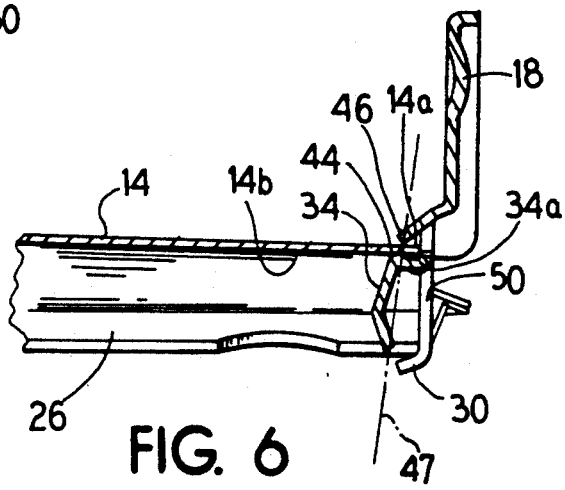
FIG. 6 is a cross sectional view, of the ring binder of FIG. 4 with the operating lever shown in locked position.
Figure 7:
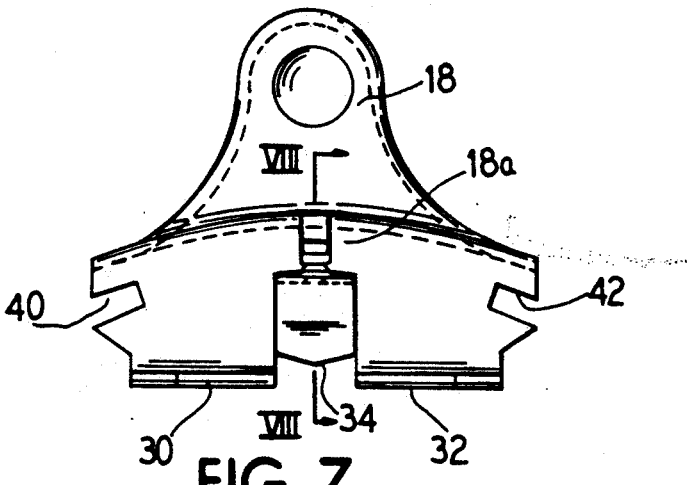
FIG. 7 is a front elevational view of one of the operating levers.

FIGS. 4, 5 and 6 illustrate the three positions of the lever members 16 and 18. FIG. 4 shows the open position, in which the lever member is rotated to its fully open position, so that the actuators 30 and 32 are rotated in a clockwise direction to force the leaves 26 and 28 upwardly as shown. During this rotation, the tongue 34 is also rotated in a clockwise direction to a raised position, which allows the leaves 26 and 28 to be raised.

When the lever is rotated from the position of FIG. 4 into the position of FIG. 5, the tongue 34 urges the leaves 26 and 28 downwardly, into the closed position, as illustrated in FIG. 5. However, in this position, the rings may be readily opened manually, in which case the leaves 26 and 28 are forced upwardly be means of manual pressure being applied thereto through the rings 10 and 12. This action causes the levers to rotate clockwise back to the opened position illustrated in FIG. 4.

When the levers are moved further in a counterclockwise direction from the position of FIG. 5 into the position of FIG. 6, a horizontal upper surface 34*a* of the central tongue 34 reaches a position under an end position 14*a* of the cover 14. This brings a projection or bump 44, located on the horizontal upper surface 34*a* of the tongue 34, under an inner surface 14*b* of the cover 14. A leg portion 46 is provided which extends obliquely from a flat surface 18*a* of the levers 16, 18. The leg portion 46 overlies the cover member 14 in a position generally above the projection 44. The leg portion prevents an upward distortion of the cover member 14 to release the projection 44.

The continued counterclockwise rotation of the operating lever from a position of FIG. 5 into the position of FIG. 6 brings about a corresponding counterclockwise rotation of the tongue 34, so that the tongue 34 is engaged with the upper surface of the leaves 26 and 28. This holds the leaves in the downward locked position as shown in FIG. 6. The leg portion 46 prevents the operating lever 18 from rotating toward its unlocked or opened position merely by application of pressure to the rings 10, 11 and 12 and leaves 26 and 28, because the clockwise torque applied by any attempt to open the leaves is insufficient to distort the cover 14 past the leg portion 46. Gentle manual pressure rotating the lever toward its clockwise direction readily releases the leg portion 46, however, so that the lever can be moved clockwise to its unlocked position as illustrated in FIG. 5, and then further to its open position as illustrated in FIG. 4.

The dashed line 47 indicated in FIG. 6, which connects the point of contact of the tongue 34 with the leaves 26, 28 and the interaction of the leg portion 46, illustrates that the tongue 34 of the operating lever has not moved to an over center or toggled position, when the operating lever is moved to its locked position. The line 47 extends downwardly toward the left, indicating that an attempted upward movement of the leaves 26 and 28 would result in a net clockwise torque tending to open the lever 18. However, the lever 18 is held in closed position by the downwardly directed spring force of the cover, backed by the leg portions 46, and an attempted upward movement of the leaves 26 and 28 by the rings is not sufficient to force open the detent.

As further explained by FIGS. 4, 5 and 6, the operating lever rotates about an axis 50, by virtue of the tabs 36 and 38 being trapped in the slots 40 and 42. As illustrated in FIG. 6, this axis is located to the right of the tongue 34, so that an attempted upward movement of the leaves 26 and 28 tends to impart a torque in the clockwise direction about the axis 50. However, as indicated above, this is insufficient to release the cover 14 from the leg portions 46.

Figure 8:
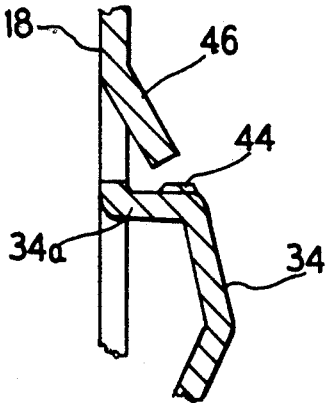
FIG. 8 is a partial cross sectional view taken generally along line VIII—VIII of FIG. 7.

Preferably, the projection 44 is an upwardly directed projection, centrally located on the upper surface of the horizontal portion 34*a* of the tongue 34, as best shown in FIG. 8.

It will appreciated that the present invention is formed of relatively few separate parts, since the cover and operating levers incorporate, in just three members, all of the structure required for pivotally mounting the operating levers and for providing the means for locking the levers in their closed position, as well as the actuators 30 and 32 for opening the rings, and the tongue 34 for closing the rings. That central location of the tongue 34 on the operating levers 16 and 18 facilitates closing the rings 10-12 with a minimum of force, and also simplifies the construction of the operating levers, as separate tongues are not required for the two hinged leaves or plates. Also, because the levers are not required to rotate so far as to reach an overcenter or toggled position, movement between opened and locked positions can be accomplished with a great economy of motion.

It is apparent that various modifications and additions may be made in the apparatus of the present invention without departing from the central features of novelty thereof, which are intended to be defined and secured by the appended claims.

I claim as my invention:

1. In a locking ring binder having openable rings connected at their base ends to hinged leaves, the hinged leaves resiliently held within a cover member wherein opening of the rings spreads an outside width of the hinged leaves against the resilient force of the cover member, the improvement comprising:

an operating lever rotatably mounted to an end of said cover member, said operating lever having a tongue portion extendable between said cover member and said hinged leaves in a selectable locked condition, preventing movement of said hinged leaves toward said cover member; and a leg portion arranged on said operating lever and overlying said cover member on a side of said cover member opposite said tongue portion when said operating lever is in said locked condition, said leg portion coacting with said tongue portion to prevent upward distortion of said cover member tending to counter rotate the operating lever to an unlocked condition.

2. The improvement according to claim 1, wherein said tongue portion comprises a projection on a surface thereof facing said cover member.

3. The improvement according to claim 2, wherein said leg portion and said projection are aligned through a thickness of said cover member.

4. The improvement according to claim 1, wherein said tongue portion comprises a generally L-shaped profile having a horizontal leg, said cover member and a generally vertical leg extending downward to abut said hinged leaves, said tongue portion rotatable to engage said hinged leaves with said vertical leg and force said leaves away from said cover member upon rotation of said operating lever from said open toward said locked condition.

5. The improvement according to claim 4, wherein said tongue portion comprises a projection on said horizontal leg, said projection facing said cover member, and said leg portion comprising a bar shaped member projecting obliquely toward said cover member, said projection obliquely aligned through a thickness of said cover member toward said leg portion when said operating lever is in said locked condition.

6. The improvement according to claim 1, wherein said operating lever comprises an actuator portion arranged to interfit against said hinged leaves on a side of said hinged leaves opposite said cover member, said actuator portion rotatable with said operating lever to move said hinged leaves toward said cover member when said operating lever is moved from said unlocked condition to said open condition.

7. The improvement according to claim 1, wherein a second operating lever is provided identical to the first described operating lever, said second operating lever arranged on an opposite end of said cover member.

8. A locking ring binder comprising:

an openable ring portion secured to a pair of plates hinged together, a cover member holding said pair of plates, and at least one operating lever rotatably mounted on said cover member having an actuator portion located below said hinged plates for moving at least a portion of said hinged plates upwardly to force said rings into an open position, said operating lever having a tongue portion arranged to interfit between said cover and said plates in a locked position and adapted to force at least a portion of said hinged plates downwardly as said operating lever is rotated to said locked position, and a leg portion, said leg portion arranged overlying said cover member when said operating lever is moved into said locked position, said leg portion and said tongue portion cooperating to clamp said cover member therebetween to resist deformation of said cover member and thereby to resist rotation of said operating lever as a result of an opening force supplied directly to said rings, whereby said leaves are locked in their closed position.

9. The binder according to claim 8, wherein said operating lever incorporates a pair of actuator portions, each of which is located under one of said hinged plates, for cooperating with the under surface of said plates, and said tongue portion being centrally located and downwardly extending for cooperating with the upper surface of said hinge plates.

10. The binder according to claim 9, wherein said tongue portion is formed with a horizontal surface adapted to underlie said cover member when said operating lever is in its locked position, and comprising a projection on the horizontal surface of said tongue portion facing said cover member.

11. The binder according to claim 10, wherein said leg portion and said projection are substantially aligned across a thickness of said cover member.

12. The binder according to claim 9, wherein said tongue portion extends inwardly of the axis of rotation about which said operating lever is rotated relative to said cover, and engages the upper surface of said hinged plates only at a location spaced inwardly from said axis of rotation, whereby rotation of said operating lever does not reach an over center position.

* * * * *